US007396302B1

(12) United States Patent
Boudreau

(10) Patent No.: US 7,396,302 B1
(45) Date of Patent: Jul. 8, 2008

(54) RELEASABLE BASKETBALL NET FOR BREAKAWAY NET ATTACHMENT SYSTEM

(75) Inventor: Cory Richard Boudreau, Madison, WI (US)

(73) Assignee: Russell Corporation, Atlanta, GA (US)

( * ) Notice: Subject to any disclaimer, the term of this patent is extended or adjusted under 35 U.S.C. 154(b) by 184 days.

(21) Appl. No.: 11/153,413

(22) Filed: Jun. 16, 2005

(51) Int. Cl.
*A63B 63/08* (2006.01)

(52) U.S. Cl. ..... 473/485; D27/701

(58) Field of Classification Search ..... 473/480, 473/479, 494, 476, 485, 489, 470; D21/701
See application file for complete search history.

(56) References Cited

U.S. PATENT DOCUMENTS

| | | | | |
|---|---|---|---|---|
| 179,476 | A | | 7/1876 | Hearttagen |
| 352,325 | A | | 11/1886 | Jensen et al. |
| 1,478,896 | A | | 12/1923 | Ferency |
| 1,491,286 | A | | 4/1924 | Calhoun |
| 1,585,840 | A | | 5/1926 | Fahnestock |
| 1,764,950 | A | | 6/1930 | Griner |
| 2,130,820 | A | * | 9/1938 | Trumbull ..... 473/470 |
| 2,199,609 | A | | 5/1940 | Bennett |
| 2,254,507 | A | | 9/1941 | Albach et al. |
| 2,489,174 | A | | 11/1949 | Cunningham |
| 2,579,312 | A | | 12/1951 | Garvey |
| 2,666,641 | A | | 1/1954 | Bonham |
| 2,884,249 | A | | 4/1959 | Cunningham |
| 3,194,555 | A | | 7/1965 | Humphrey |
| 3,216,685 | A | | 11/1965 | Raymond |
| 3,252,677 | A | | 5/1966 | Raymond |
| 3,262,662 | A | | 7/1966 | Gastaldi |
| 3,348,272 | A | | 10/1967 | Germani |
| 3,582,032 | A | | 6/1971 | Placek |
| 3,595,573 | A | | 7/1971 | Kilbourne |
| D238,284 | S | | 12/1975 | Toedter |
| 4,071,238 | A | | 1/1978 | Chapman |
| 4,082,269 | A | | 4/1978 | Hill |
| 4,194,734 | A | | 3/1980 | Tyner |
| 4,241,916 | A | | 12/1980 | Palm |
| 4,353,548 | A | | 10/1982 | Mahoney |
| 4,358,080 | A | | 11/1982 | Wolker |
| 4,365,802 | A | | 12/1982 | Ehrat |

(Continued)

FOREIGN PATENT DOCUMENTS

| | | |
|---|---|---|
| DE | 29 08 120 | 9/1980 |

(Continued)

OTHER PUBLICATIONS

Breakaway webpage, LY-cc403 safety breakaway connector, 2000, www.umei.com/laynard/safety-breakaway-connector-ly-cc403-8.htm, 3 pages.*

(Continued)

*Primary Examiner*—Gene Kim
*Assistant Examiner*—M. Chambers

(57) ABSTRACT

The present invention relates to a basketball net for a breakaway net attachment system that detachably mounts a basketball net to the rim of a basketball goal. The attachment system may include clasps located in the attachment loops of the basketball net. The clasps may release in response to an application of a predetermined force applied to the basketball net. Once released, the attachment loops may disengage form the basketball rim, effectively allowing the basketball net to breakaway from the basketball rim.

8 Claims, 5 Drawing Sheets

U.S. PATENT DOCUMENTS

| | | | | |
|---|---|---|---|---|
| 4,433,839 | A | | 2/1984 | Simonseth |
| 4,438,923 | A | | 3/1984 | Engle et al. |
| 4,441,709 | A | | 4/1984 | Schroeder et al. |
| 4,465,277 | A | | 8/1984 | Dittrich |
| 4,534,556 | A | | 8/1985 | Estlund et al. |
| 4,575,079 | A | | 3/1986 | De Faveri |
| 4,583,732 | A | | 4/1986 | Allen |
| 4,676,503 | A | | 6/1987 | Mahoney |
| 4,802,646 | A | | 2/1989 | Cattani |
| 4,805,903 | A | | 2/1989 | McArdle |
| 4,834,368 | A | | 5/1989 | Qualley |
| 4,846,469 | A | | 7/1989 | Nye |
| 4,903,964 | A | | 2/1990 | Anderson |
| 4,905,995 | A | | 3/1990 | Apo |
| 4,917,340 | A | | 4/1990 | Juemann et al. |
| 4,932,626 | A | | 6/1990 | Guillot |
| 5,007,637 | A | | 4/1991 | Foley |
| 5,098,091 | A | | 3/1992 | McGivern |
| 5,123,642 | A | | 6/1992 | Stokes |
| 5,230,489 | A | | 7/1993 | White et al. |
| D340,486 | S | * | 10/1993 | Rothbard ..... D21/703 |
| 5,301,939 | A | | 4/1994 | Ellsworth |
| 5,305,997 | A | | 4/1994 | Jolly |
| 5,338,023 | A | | 8/1994 | Stovall |
| 5,360,208 | A | | 11/1994 | Fang |
| 5,381,588 | A | | 1/1995 | Nelson |
| 5,524,883 | A | | 6/1996 | Allen et al. |
| 5,575,470 | A | | 11/1996 | Sherman |
| 5,792,010 | A | | 8/1998 | Allen et al. |
| 5,944,623 | A | * | 8/1999 | Schlicting ..... 473/489 |
| 5,951,416 | A | | 9/1999 | Allen et al. |

FOREIGN PATENT DOCUMENTS

| | | |
|---|---|---|
| EP | 0329 893 | 8/1989 |
| GB | 816709 | 7/1959 |
| GB | 894867 | 4/1962 |
| GB | 1 214 739 | 12/1970 |
| GB | 1 338 325 | 11/1973 |
| GB | 1 438 758 | 6/1976 |
| GB | 2005758 | 4/1979 |
| GB | 1 553 077 | 9/1979 |

OTHER PUBLICATIONS

Huffy Sports Parts List and Assembly Instruction Sheet, Oct. 5, 1993.
Brochure, "OBO stud welding/The better solution", OBO Bettermann (Bettermann of American, Inc., Pittsburgh, PA), 11 pages, publication date unknown.
Murray, C.J. (ed.), "Plastic Net Clips Make Basketball Safer," Design News, May 8, 1995, p. 73.
Slam Dunk Rim, Inc. advertising circular, type 3, Apr. 1987.
EPO Search Report EP 95 30 4948, Nov. 7, 1995.

* cited by examiner

RELEASABLE BASKETBALL NET FOR BREAKAWAY NET ATTACHMENT SYSTEM

BACKGROUND OF THE INVENTION

The invention relates to a system for detachably retaining a net on a basketball goal rim and, more particularly, to a basketball net clip for detachably retaining a net on a basketball goal rim whereby the net may be released from the rim upon application of a predetermined force.

Basketball goal nets are typically retained on the rim of a goal by attaching looped end portions of the net to hooked portions, known as rams, welded to the rim of the goal. By passing the looped portions of the net over the rams, the net is retained on the rim during use of the goal, for example during a game of basketball.

Under certain circumstances it is desirable to permit the net to detach from the rim of the goal whereby a force, in excess of what may be applied during normal play, will not be conveyed through or resisted by the connection point between the net and the rim. For example, when a player engages and produces a pulling force on the net, it is desirable for the net to be capable of separating from the rim rather than tearing the net or damaging the rim and/or the associated support apparatus. However, during the normal course of play, the net should remain engaged with the rim.

In one known net attachment system, net clips are used to secure a conventional net to a rim. Unfortunately, the net clip systems required a special rim fabricated to accept the net clips. The net clips connect to specially formed holes in the underside of the rim and also connect to the loops of a conventional net. As a result however, the attachment of the net is difficult and time consuming to assemble. Further, the system requires the use of loose clips or pieces that are separate from the net and the rim and may be freed during release. Consequently, the loose clips are easily lost or misplaced during release and/or assembly.

In another known net attachment system, plastic ties are used with a conventional rim. The plastic ties wrap around the rams of the rim and the looped end portions of the net whereby the net is retained on the rim of the goal. The ends of each of the plastic ties are connected to each other and will separate from each other when a large force is applied to the net, thereby permitting the net to separate from the rim of the goal.

Although the plastic ties may be used with a conventional rim, the plastic ties still present difficulties for assembly and reattachment. When the net is released from the rim, the connecting ties are freed from both the net and the rim such that they may be lost. As with other systems, if the connecting ties are misplaced during assembly or lost during release, the proper attachment or the reattachment of the net to the rim may be hindered or made impossible.

Accordingly, there is a need for a basketball goal net attachment system whereby the net may be attached to the rim of an existing basketball goal in a typical manner, and which further ensures that the components of the attachment system remain associated with the system during detachment of the net from the rim.

SUMMARY OF THE INVENTION

According to one embodiment, the present invention may include a releasable basketball net for use with a basketball goal rim. The releasable basketball net may included a net body portion defining an opening through which a basketball passes during play and a plurality of loop portions joined to the body portion. The loop portions may be configured to connect to the basketball rim such that the body portion is suspended below the basketball rim and the opening is substantially co-aligned with the basketball rim. Each loop portion may have a first segment, a second segment and a means for releasing the first segment from the second segment. The releasing means may also include a clasp or coupler releasably connecting the first segment to the second segment. The releasable basketball net may also be configured to release from the basketball rim in response to an application of a predetermined force.

According to another embodiment, the present invention may include a method of detachably retaining a basketball net on a basketball goal rim. The method may include forming the basketball net having a net body portion and a plurality of loop portions with each loop portions including a first segment and a second segment and including a plurality of releasing means detachably connecting the first segment to the second segment of each of the plurality of loop portions. The method may also include installing the basketball net such that the plurality of loop portions connect to the basketball rim and suspend the body portion below the basketball rim and releasing at least one of the plurality of loop portions from the rim, such that the releasing means releases the first segment from the second segment, in response to an application of a predetermined force on the net.

BRIEF DESCRIPTION OF THE DRAWINGS

While the specification concludes with claims particularly pointing out and distinctly claiming the present invention, it is believed the same will be better understood from the following description taken in conjunction with the accompanying drawings, which illustrate, in a non-limiting fashion, the best mode presently contemplated for carrying out the present invention, and in which like reference numerals designate like parts throughout the Figures, wherein:

DETAILED DESCRIPTION

The present disclosure will now be described more fully with reference the to the figures in which various embodiments of the present invention are shown. The subject matter of this disclosure may, however, be embodied in many different forms and should not be construed as being limited to the embodiments set forth herein.

Figure 1:
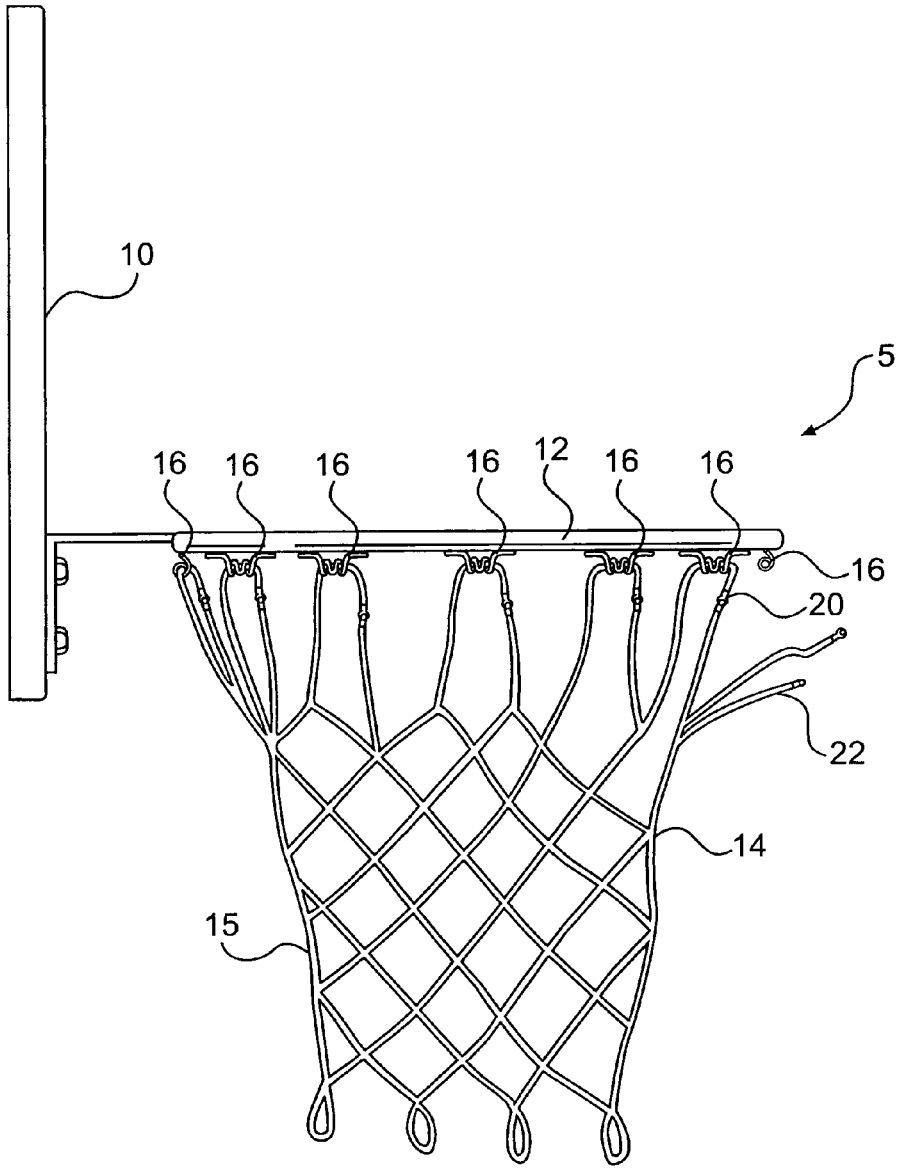
FIG. 1 is a side view of a basketball goal incorporating a breakaway net attachment system according to one embodiment of the present invention.

Referring to FIG. 1, one embodiment of the present invention is shown as a breakaway net attachment system 5 that releasably attaches and orients a basketball net 14 in a manner consistent with the conventional basketball goal system. The basketball goal includes a backboard 10, which supports a basketball goal rim 12 and conventional rams 16, used to attach basketball nets. The breakaway net attachment system includes a body portion 15 and a plurality of attachment loops 22. As shown in FIG. 1, the plurality of attachment loops 22 releasably suspends the net 14 under the rams 16. Each attachment loop 22 includes a net releasing means 20, which is releasable in response to a separating force. One of attachment loops 22 is shown detached from rim 12 with the releasing means 20 separated. It should be noted that the net attachment system does not include any loose or separate parts that may be lost or misplaced during attachment to or release from the rim.

Figure 2:
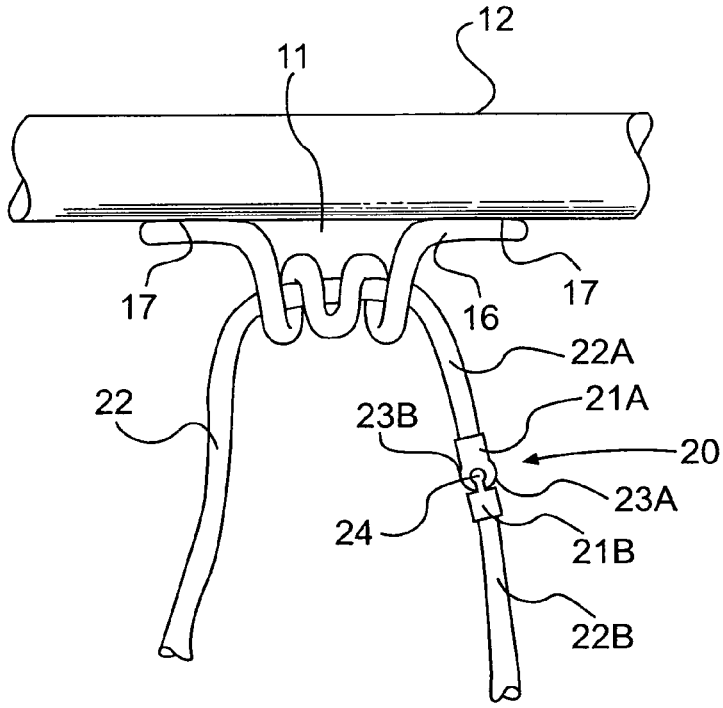
FIG. 2 is a front view of an attachment loop of a net breakaway net attachment system according to one embodiment of the present invention.
Figure 3:
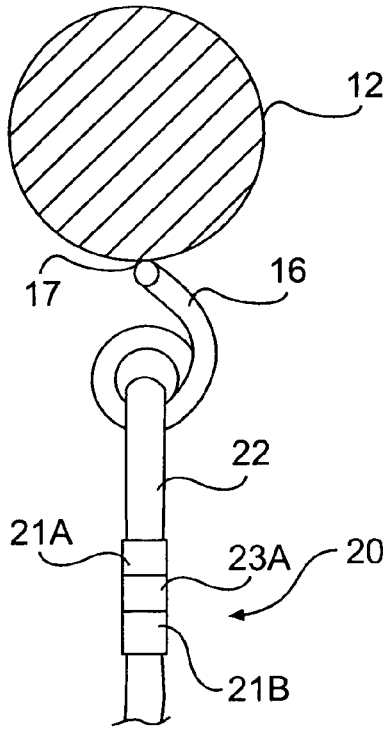
FIG. 3 is a side view of the attachment loop of FIG. 2 according to one embodiment of the present invention.

FIGS. 2 and 3 illustrate front view and a side view respectively of a single ram 16 on the rim 12 and a single attachment loop 22 of the net 14. The ram 16 includes a length of metal with a tubular cross-section and two ends and is typically welded to rim 12 at attachment points 17. A traditional ram 16 is typically bent or formed such that the metal of ram 16 forms a cylindrical shape as shown in FIGS. 2 and 3.

The attachment loop 22 shown in FIGS. 2 and 3 engages the ram 16 by passing through the opening formed in the ram 16. In hanging a basketball net, the loops 22 of the basketball net are typically fed over the cylindrical shaped portion of the ram 16 such that the loop 22 passes through the center opening as shown in FIGS. 2 and 3. The net attachment system of the present invention may be hung in this conventional manner does not require the releasing means 20 to be separated. However, separating the releasing means 20 and passing one end through the ram 16 as shown in FIGS. 2 and 3 may be done to assist in hanging the net 14.

It should also be noted that in the absence of rams 16 on the rim 12, the releasing means 20 may also be used to attach the net 14 to rims that do not use rams. The attachment loops 22 may be secured directly to the rim 12 by separating the releasing means 20 and passing the loop 22 over the rim 12.

Figure 4:
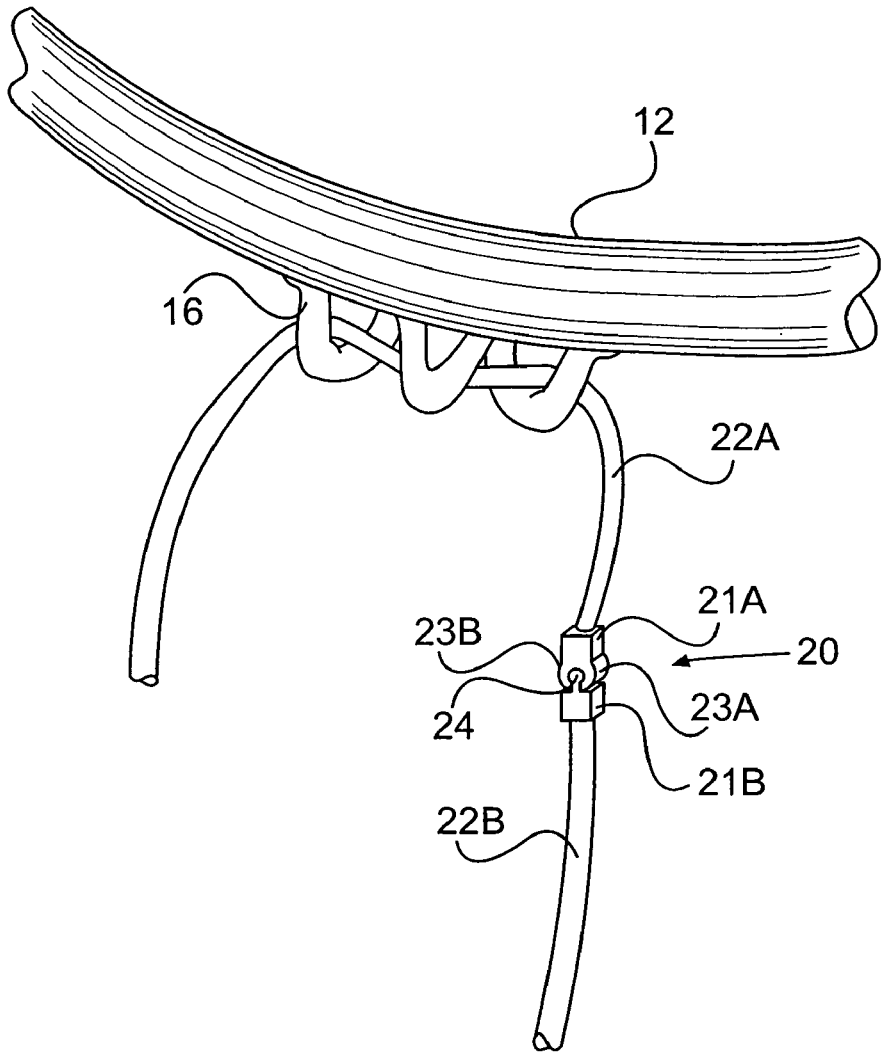
FIG. 4 is a perspective view of the attachment loop of FIG. 2 according to one embodiment of the present invention.

One embodiment of the releasing means 20 is shown in FIGS. 2, 3, and 4 and includes connectors 21A and 21B. The connectors 21A and 21B are fastened together and function, along with the loop 22, to support the body portion 15 of the net below the rim 12. A first segment 22A of the loop 22 is attached to the connector 21A and a second segment 22B of the loop 22 is attached to the connector 21B. When connected, releasing means 20 acts as part of the loop 22 such that the net 14 functions as a conventional net 14.

Referring to FIGS. 2, 3, and 4, one embodiment of the releasing means 20 is depicted as a type of clip connector. FIG. 2 provides a front view of the releasing means 20 in a fastened configuration and FIG. 3 provides a side view of the releasing means in a fastened configuration. FIG. 4 includes a perspective view of the fastened releasing means 20 and the associated loop 22. The connector 21A includes a socket portion having two protruding arm sections 23A and 23B which define a cylindrical recess. The ball portion of the connector 21B comprises a cylindrical shape 24 with a substantially circular cross-section.

In the embodiment shown in FIGS. 2, 3, and 4, the cylindrical shape 24 is receivable between the protruding arms 23A and 23B. The cylindrical shape 24 may be coupled with the protruding arm sections 23A and 23B by forcing the cylindrical shape 24 between the arm sections 23A and 23B, such that the arm section flex around the cylindrical shape 24. As would be obvious to one of ordinary skill, the cylindrical shape 24 may also slide between the arm sections 23A and 23B from one end without forcing the arm sections to deform. Under a predetermined separating force, for example, the weight of an individual hanging on the net causing the connector 21A to pull away from connector 21B, the socket portion of connector 21A may flex or deform. Upon reaching the predetermined force, the protruding arm sections 23A and 23B may sufficiently flex, such that the cylindrical shape 24 of connector 21B is released from the protruding arm sections 23A and 23B, thereby releasing any support the loop 22 provides to the net 14.

The releasing means 20 may be configured to remain fastened under the weight of the net and under ordinary playing conditions. However, the releasing means 20 may be configured to separate upon an application of the predetermined separating force, for example the weight of a basketball player accidentally entangled in the net or intentionally hanging from the net.

Although FIGS. 2, 3, and 4 show the releasing means 20 located on the loop 22 and on the right side of the ram 16, it should be obvious to one of ordinary skill that the releasing means may be located anywhere within the load path of the loop 22. For example, the releasing means 20 may be located on the loop 22 on the opposite side of the ram 16 or located in the ram 16 without deviating from the true scope and spirit of the present invention.

Figure 5:
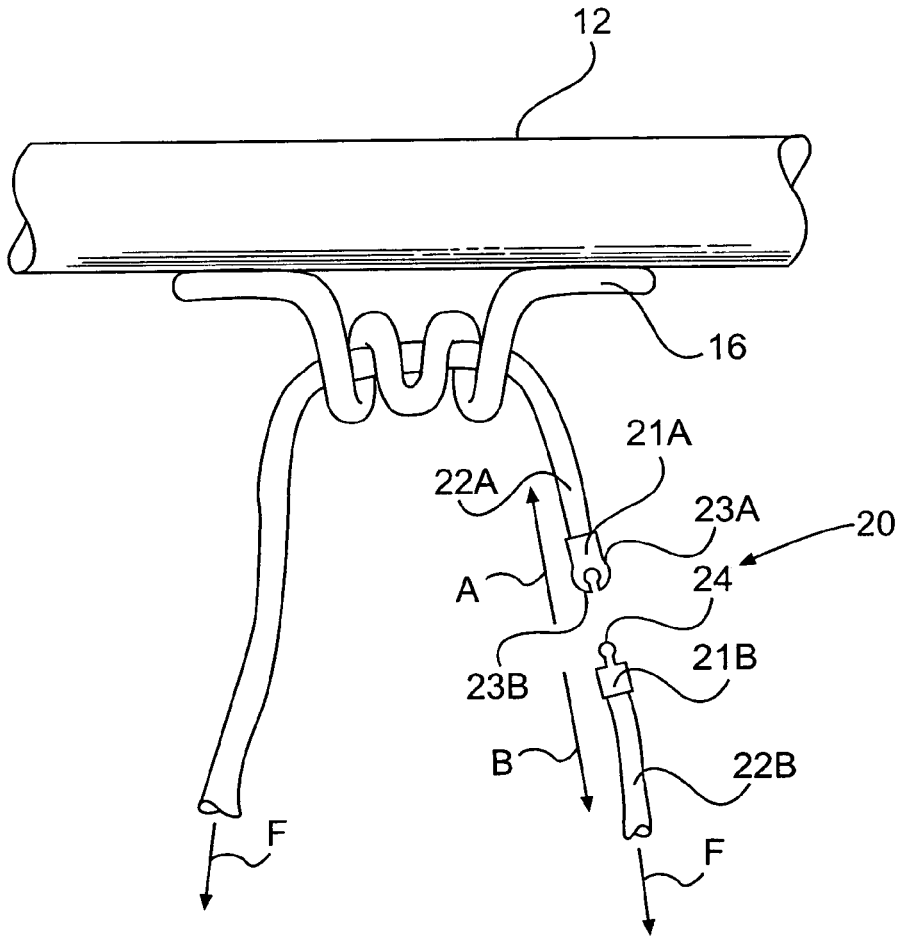
FIG. 5 is a front view of the attachment loop of FIG. 2 during release of the breakaway net attachment system according to one embodiment of the present invention.

FIG. 5 shows the releasing means 20 separating under a force "F" applied to the segment 22A and the segment 22B such that the connectors 21A and 21B separate in the direction of the arrows labeled "A" and "B" respectively. In this manner, the loop 22 may be separated into its segments 22A and 22B and, by doing so, may no long support any weight. Further, by releasing at a the predetermined separating force, the releasing means 20 guarantees that, prior to separation, no forces above the level of the predetermined separating force are transmitted to the rim 16.

By separating at the predetermined separation force, the rim 12 and the backboard 10 may be spared from damage or fatigue resulting from heavy loads and high stresses transferred through the net. Further, the separation of the releasing means 20 also preserves the life of the net 14 by releasing before stretching and/or breakage of the net occurs under heavy loads.

Figure 6:
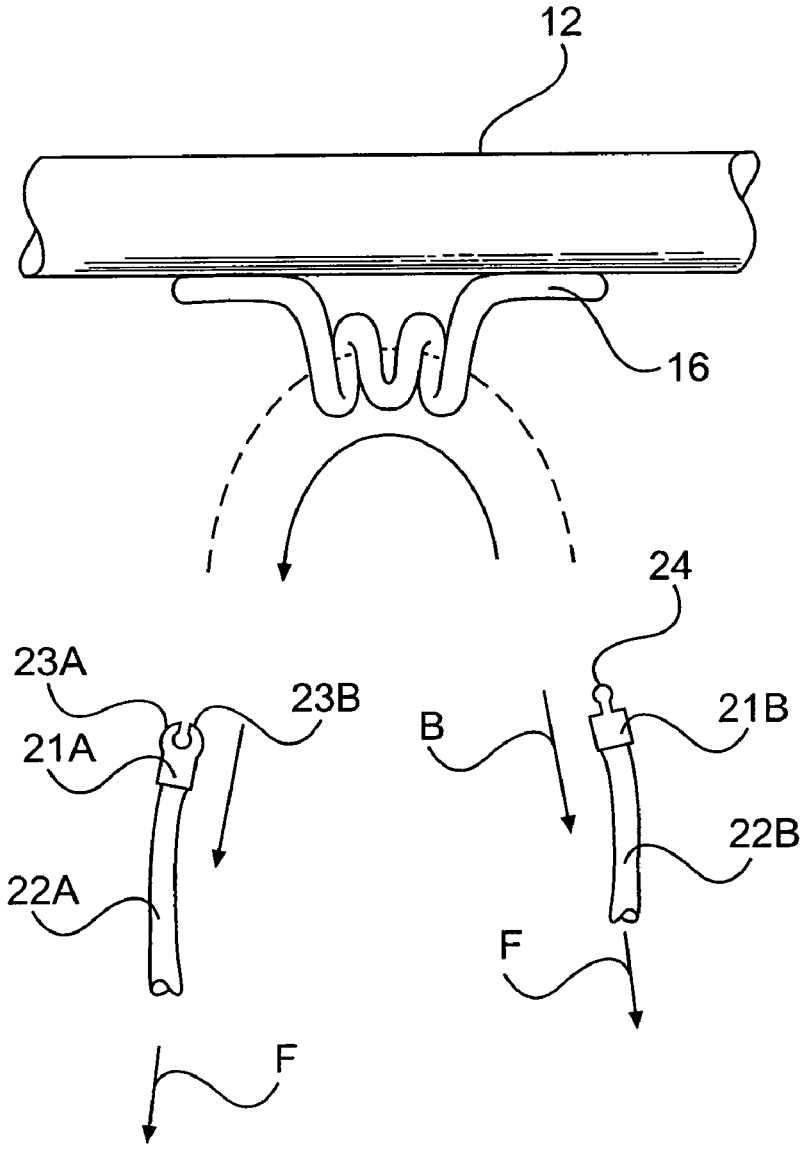
FIG. 6 is a front view of the attachment loop of FIG. 2 releasing from the basketball rim according to one embodiment of the present invention.

FIG. 6 shows how the net 14 and the loops 22 may disengage from the rams 16. The dotted line shown in FIG. 6 indicates the path that the segment 22A follows after separation of the releasing means 20. The segment 22A and the connector 21A are pulled through the cylindrical opening (shown in FIG. 3) in the ram 16 in the direction of the curved arrow. In the case of a player grabbing the net during play, every releasing means 20 may not necessarily release before the player lets go of the net, resulting in a partial separation of the net from the rim. In such a case, the net may be reattached by simply reconnecting the released loops on the net.

However, in the case of a player being accidentally stuck in the net or intentionally holding onto the net, all of the loops 22 may eventually release from the rim to prevent harm to the player and damage to the rim and supporting structure. After each connector 21A passes through the associated rams 16, the net 14 may be completely released from the rim 12. It should be understood that the connector 21A or 21B must be sized and shaped to pass through the ram 16 during release.

It should be obvious to one of ordinary skill that the releasing means 20 are integral with the net 14 and do not consist of loose or separate pieces. As such, the possibility of losing pieces may be eliminated or minimized, allowing the net attachment system of the present invention to be reattached properly in a time efficient manner.

Preferably, the net 14 may be reused after a partial or full release of the net by refastening the releasing means 20 and hanging the net 14 as described above. Alternatively, however, the releasing means 20 may be configured as a single use mechanism. In such a configuration, the net may function as a conventional net but may release under emergency circumstances and heavy loads to protect the players from physical injuries and the rim and supporting structure from damage.

The releasing means 20 as shown in FIGS. 2-6, may be formed from a commercially available polypropylene or other plastics known to those in the art for fabricating couplers and connectors. Of course, other materials may be used instead of polypropylene or other plastics and different properties may be designed for without departing from the principles of the invention, as will be readily apparent to the skilled artisan.

Additional embodiments of the releasing means 20 may include other types of couplers, connectors, or attachment methods as would be obvious to one of ordinary skill in the art. The releasing means may also include such attachment means as adhesives and hook and loop fasteners.

It is contemplated that the net 14 may include embodiments for single-use releasable nets. For example, the connectors described above may be designed as single or minimal repeated-use mechanisms that destructively release upon separation. Furthermore, the net 14 may include a weakened portion of the loop 22 as the releasing means 20, which may support the net during ordinary play conditions but will destructively release the net 14 upon an application of a predetermined force. The weakened portion of the loop 22 may replace the reusable connectors as a releasing means 20 or be used in addition as an additional safety measure to protect player and equipment from high loads being applied to the rim and the backboard.

It is also contemplated that existing basketball nets may be modified to include the net attachment system of the present invention by cutting each attachment loop into two segments and placing a releasing means between the two segments as shown on net 14. Upon completion, the modified net would be attached to the rim and function as described above.

From the above description, it should be apparent that the breakaway net attachment system of the invention is adapted to retain the net on a basketball goal rim in a manner which ensures that the net remains in place during normal play and which permits the net to be detached from the rim in response to the application of a predetermined force. In addition, it should be noted that the present system is particularly designed to permit a loop 22 to become detached upon the application of a force in the range of 25-50 lbs. to a single releasing means 20. Further, the system may be adapted to release the net from a basketball goal rim when a force of 140 lbs. is applied to the net.

While the forms of apparatus and processes herein described constitute embodiments of this invention, it is to be understood that the invention is not limited to these precise forms, and that changes may be made therein without departing from the scope of the invention which is defined in the appended claims.

What is claimed is:

1. A reusable releasable basketball net for use with a basketball goal rim, the net comprising:

a net body portion defining an opening through which a basketball passes during play;

a plurality of loop portions joined to the body portion and configured to connect to the basketball rim such that the body portion is suspended below the basketball rim and the opening is substantially co-aligned with the basketball rim, each loop portion having a first segment, a second segment, and a releasing apparatus for releasing the first segment from the second segment;

said releasing apparatus having a first element attached to the first segment of the loop portion and a second element attached to the second segment of the loop portion, the first element including a base attached to the first segment and at least two arms extending outward from the base and positioned substantially parallel to each other so as to form a recess, the second element including a protruding portion frictionally fittable within the recess such that the first element and the second element are held together; and wherein the first element separates from the second element in response to an application of a predetermined force on the net.

2. The reusable releasable basketball net according to claim 1, wherein the basketball rim includes a plurality of rams and wherein the plurality of loop portions engage the plurality of rams such that the releasing apparatuses are structured and arranged to pass through the rams upon release of the first segment from the second segment.

3. The reusable releasable basketball net according to claim 1, wherein the predetermined force on the net is approximately 140 lbs.

4. The reusable releasable basketball net of claim 1, wherein said second element is substantially cylindrical.

5. A basketball apparatus comprising:

a basketball goal rim including a plurality of rams; and a reusable basketball net having a plurality of loop portions corresponding to the plurality of rams and connecting to the plurality of rams to suspend the basketball net, each of the loop portions having first segment and a second segment connected by a releasable coupler;

said coupler including a first and second portion, the first portion including a base attached to the first segment and at least two arms extending outward from the base and positioned substantially parallel to each other so as to form a recess, and the second portion frictionally fittable within the recess such that the first portion and second portion are held together, and wherein the first portion separates from the second portion in response to an application of a predetermined force on the net such that at least one loop portion disengages from the rim.

6. The Apparatus of claim 5, wherein said second portion is substantially cylindrical.

7. A method of detachably retaining a basketball net on a basketball goal rim, the method steps comprising:

forming the basketball net having a net body portion and a plurality of loop portions, each of the loop portions including a first segment with a first portion including a base attached to the first segment and at least two arm sections extending outward from the base and positioned substantially parallel to the each other so as to form a recess and a second segment with a second portion frictionally fittable within the recess;

detachably connecting the first portion to the second portion of each of the plurality of loop portions;

installing the basketball net such that the plurality of loop portions connect to the basketball rim and suspend the body portion below the basketball rim; and releasing at least one first portion from a second portion in response to an application of a predetermined force on the net.

8. The method of claim 7, wherein said second portion is substantially cylindrical.

* * * * *